US007252454B2

(12) United States Patent
Bradford et al.

(10) Patent No.: US 7,252,454 B2
(45) Date of Patent: Aug. 7, 2007

(54) EXPANSION JOINT SYSTEM INCLUDING DAMPING MEANS

(76) Inventors: Paul Bradford, 2673 Dodge Rd., East Amherst, NY (US) 14051; David Kent Fugard, 38 Duncan Drive, St. Catherines, Ontario (CA) L2N 3P2

( * ) Notice: Subject to any disclaimer, the term of this patent is extended or adjusted under 35 U.S.C. 154(b) by 180 days.

(21) Appl. No.: 10/977,407

(22) Filed: Oct. 29, 2004

(65) Prior Publication Data

US 2005/0262650 A1 Dec. 1, 2005

Related U.S. Application Data

(60) Provisional application No. 60/516,329, filed on Oct. 31, 2003.

(51) Int. Cl.
*E01C 11/02* (2006.01)
*E01D 19/06* (2006.01)

(52) U.S. Cl. ..... 404/47; 404/51; 14/73.1

(58) Field of Classification Search ..... 404/47, 404/69; 14/73.1, 73.5

See application file for complete search history.

(56) References Cited

U.S. PATENT DOCUMENTS

| | | | |
|---|---|---|---|
| 3,482,492 | A | 12/1969 | Bowman |
| 3,699,853 | A | 10/1972 | Wicks |
| 4,007,994 | A | 2/1977 | Brown |
| 4,030,156 | A | 6/1977 | Raymond |
| 4,075,728 | A | 2/1978 | Puccio |
| 4,076,440 | A | 2/1978 | Bertschmann |
| 4,080,086 | A | 3/1978 | Watson |
| 4,111,582 | A | 9/1978 | Tippett |
| 4,120,066 | A | 10/1978 | Leroux |
| 4,339,214 | A | 7/1982 | Puccio et al. |
| 4,516,284 | A | 5/1985 | Huber et al. |
| 4,533,278 | A | 8/1985 | Corsover et al. |
| 4,674,912 | A | 6/1987 | Buckenauer |
| 4,784,516 | A | 11/1988 | Cox |
| 4,923,328 | A | 5/1990 | Arps et al. |
| 5,060,439 | A | 10/1991 | Clements et al. |
| 5,067,297 | A | 11/1991 | Sobol |
| 5,863,148 | A | 1/1999 | Shivaram |
| 5,887,308 | A | 3/1999 | Walter |
| 6,039,503 | A | 3/2000 | Cathey |
| 2003/0196400 | A1 | 10/2003 | Braun |
| 2004/0016065 | A1 | 1/2004 | Steiger et al. |

FOREIGN PATENT DOCUMENTS

| | | | |
|---|---|---|---|
| JP | 2001107303 | A | 4/2001 |

OTHER PUBLICATIONS

WABO® Modular Expansion Joint Systems—Brochure (1986).

STEELFLEX® Modular Expansion Joint System—Brochure (1996).

TechStar, Inc. Expansion Joints, Modular Joints, Robek System—Brochure.

Maurer Sohne—Swivel Joist Expansion Joint—Brochure (1996).

U.S. Appl. No. 10/948,979; Applicants: Paul Bradford et al.; filed Sep. 24, 2004.

U.S. Appl. No. 10/949,050; Applicants: Paul Bradford et al.; filed Sep. 24, 2004.

*Primary Examiner*—Raymond Addie
(74) *Attorney, Agent, or Firm*—Curatolo Sidoti Co., LPA; Joseph G. Curatolo; Salvatore A. Sidoti

(57) ABSTRACT

An expansion joint system for roadway constructions is provided incorporating dampers that are designed to protect the roadway constructions from the effects of disturbances caused by seismic events and vehicular traffic by absorbing and dissipating mechanical vibration energy.

35 Claims, 5 Drawing Sheets

EXPANSION JOINT SYSTEM INCLUDING DAMPING MEANS

The present application claims the benefit of the filing date under 35 U.S.C. 119(e) of U.S. Provisional Application for Patent Ser. No. 60/516,329, filed Oct. 31, 2003, which is hereby incorporated by reference.

BACKGROUND

The invention relates to an expansion joint system incorporating damping means, which may be utilized in various roadway constructions where gaps are present between adjacent concrete sections of the roadway construction. The expansion joint including damping means is useful in roadway constructions, including, for example, bridge constructions and other roadway structures where absorption and dissipation of mechanical vibrations is desired.

In a roadway construction, such as highways and bridges, a gap is intentionally provided between adjacent concrete structures for accommodating dimensional changes within the gap occurring as expansion and contraction due to temperature changes, shortening and creep caused by prestressing of the concrete, seismic disturbances, and deflections and longitudinal forces caused by vehicular traffic. An expansion joint is typically utilized to accommodate these movements in the vicinity of the gap.

Bridge constructions are especially subject to dimensional changes and movement caused by seismic events and vehicular traffic. This raises particular problems, because the movements occurring during such seismic events are not predictable either with respect to the magnitude of the movements or to the direction of the movements. In many instances, bridges have become unusable for significant periods of time, due to the fact that traffic cannot travel across damaged expansion joints.

Damping is the absorption of mechanical energy by a material in contact with the source of that energy. It is desirable that the damping materials be highly effective in converting this mechanical energy into heat energy rather than transmitting it to the surroundings.

The use of viscous dampers as "anti-seismic devices" to dampen vibrations caused by seismic cycling and vehicular traffic in bridge construction is known. Viscous dampers typically provide damping by forcing a piston rod into a housing containing a viscous material, such as an oil. The mechanical vibration energy exerted on the bridge structure is decreased when the piston rod pushes through the viscous fluid, as the mechanical energy is converted to heat energy. Thus, damping is achieved. These viscous dampers are often installed across an expansion joint, but are not incorporated into the expansion joint system itself.

Heretofore, the art has not disclosed an expansion joint system having damping means incorporated therein. Therefore, a need still exists for an improved expansion joint system that can absorb and dissipate vibration energy that may be caused by seismic events and vehicular traffic, occurring in the vicinity of a gap having an expansion joint installed between two spaced apart, adjacent roadway sections.

SUMMARY

An expansion joint system for a roadway construction is provided wherein a gap is defined between adjacent first and second roadway sections, said expansion joint system extending across said gap to permit vehicular traffic, said expansion joint system comprising transversely extending load bearing members having top and bottom surfaces, wherein said top surface is adapted to support vehicular traffic; elongated support members having opposite ends extending longitudinally across said expansion joint from said first roadway section to said second roadway section, wherein said elongated support members are positioned below said transversely extending load bearing members; means for movably engaging said elongated support members with at least one of said transversely extending load bearing members; and dampers positioned between at least one of said transversely extending load bearing members and said means for engaging said elongated support members with at least one of said transversely extending load bearing members.

According to another embodiment, said expansion joint system comprises transversely extending load bearing members having top and bottom surfaces, wherein said top surface is adapted to support vehicular traffic; elongated support members having opposite ends extending longitudinally across said expansion joint from said first roadway section to said second roadway section, wherein said elongated support members are positioned below said transversely extending load bearing members; at least one first receptacle for accepting an end of one longitudinally extending elongated support member, wherein said first receptacle for accepting substantially restricts transverse movement within said one first receptacle for accepting, but permits longitudinal and vertical movement within said first receptacle for accepting; at least one second receptacle for accepting an end of one longitudinally extending elongated support member, wherein said second receptacle for accepting substantially restricts longitudinal movement within said second receptacle for accepting, but permits transverse and vertical movement within said second receptacle for accepting, wherein said elongated support members have one end located within said first receptacle for accepting and the opposite end located in said second receptacle for accepting; means for movably engaging said elongated support members with at least one of said transversely extending load bearing members; and dampers connected between said elongated support members and at least one of (i) said first receptacle for accepting said elongated support members and (ii) said second receptacle for accepting said elongated support members.

According to a further embodiment, said expansion joint system comprises transversely extending load bearing members having top and bottom surfaces, wherein said top surface is adapted to support vehicular traffic; elongated support members having opposite ends extending longitudinally across said expansion joint from said first roadway section to said second roadway section, wherein said elongated support members are positioned below said transversely extending load bearing members; means for movably engaging said elongated support members to at least one of said transversely extending load bearing member; at least one expansion and contraction means for controlling the spacing between said load bearing members comprising pivotably attached arms that are movably engaged with said load bearing members; and dampers connected to said pivotably attached arms of said expansion and contraction means.

According to a further embodiment, said expansion joint system comprises transversely extending load bearing members having top and bottom surfaces, wherein said top surface is adapted to support vehicular traffic; elongated support members having opposite ends extending longitudinally across said expansion joint from said first roadway section to said second roadway section, wherein said elongated support members are positioned below said transversely extending load bearing member; means for movably engaging said elongated support members with at least one of said transversely extending load bearing members; and dampers connected between two components selected from the group consisting of (a) said transversely extending load bearing members, (b) said elongated support members, and (c) said means for movably engaging said elongated support members with at least one of said transversely extending load bearing members.

DETAILED DESCRIPTION

Figure 1:
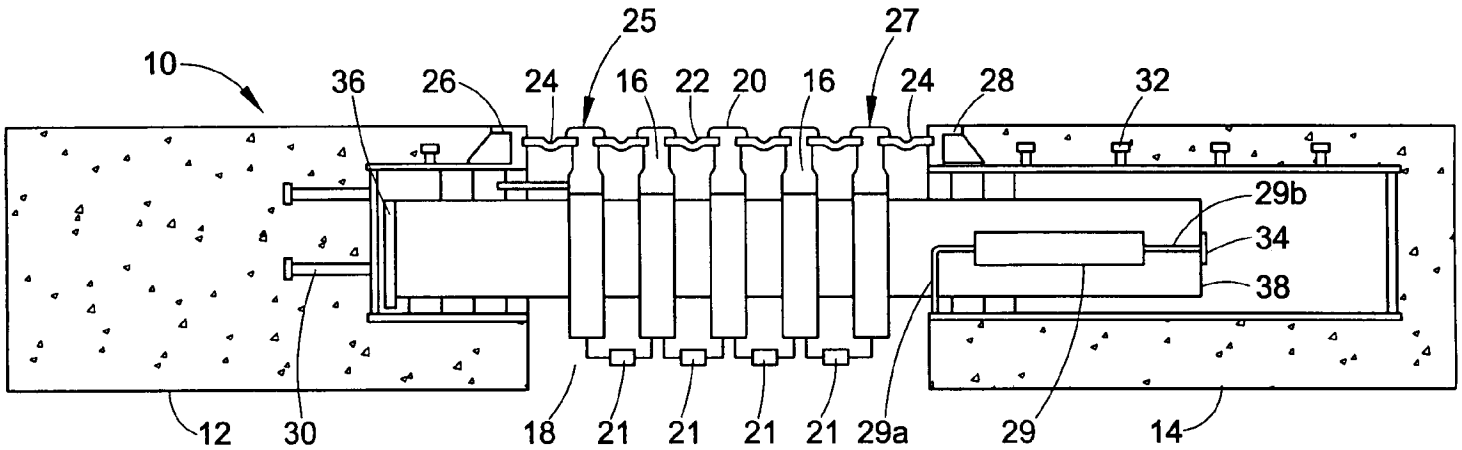
FIG. 1 is a side view of one embodiment of the expansion joint system.

An expansion joint system is provided for use in roadway constructions. The expansion joint system is designed to be installed in the gap between spaced apart, adjacent concrete roadway sections and bridge sections. The expansion joint system incorporates dampers at various locations, which are designed to absorb and dissipate mechanical vibrations in the vicinity of the gap that are caused by seismic cycling and vehicular forces. The expansion joint system may be used to absorb vibration energy in the vicinity of the gap that is applied to the expansion joint from different directions.

The use of dampers in the expansion joint system provides additional lateral resistance (i.e.—damping) to movements caused by seismic events between any two or more components of the expansion joint system by friction damping, material yielding, or viscous energy dissipation. Thus, dampers may be incorporated between points of relative movement between any two or more components of the expansion joint system to provide damping of movements in the vicinity of the gap between two spaced apart concrete bridge or highway sections. The expansion joint system includes dampers that are capable of achieving damping of movements in the vicinity of the gap that are greater than about 1 inch and which occur in less than about 1 second. The dampers provide additional resistance above the level of friction resistance normally associated with the bearings that are typically incorporated into an expansion joint system. The expansion joint system may include dampers connected to and/or between the transversely extending vehicular load bearing members, elongated support bar members, support bar receptacles, yoke assemblies, and means for controlling the distance between the transversely extending load bearing members.

The expansion joint system generally includes at least one load bearing member that extends transversely within an expansion joint and damping means for absorbing mechanical vibrations. The load bearing member may be comprised of a plate structure or beam structure. According to one embodiment, the expansion joint system may include vehicular traffic loading bearing members that extend transversely within an expansion joint, at least one elongated support member that is positioned below the transversely extending load bearing members and which extends longitudinally in the expansion joint across the gap, an assembly for engaging the support member with at least one transversely extending load bearing member in a movable relationship, and dampers for absorbing mechanical vibrations.

According to certain embodiments, the expansion joint system may include a plurality of vehicular traffic load bearing members that extend transversely within an expansion joint, at least one support member positioned below the transversely extending load bearing members and which extends longitudinally in the expansion joint across the gap, an assembly for engaging the elongated support bars with at least one of the transversely positioned load bearing members, and dampers for absorbing mechanical vibrations.

According to other embodiments, the expansion joint system includes a plurality of vehicular traffic loading bearing members that extend transversely within an expansion joint, at least one elongated support member that is positioned below the transversely extending load bearing members and which extends longitudinally in the expansion joint across the gap, an assembly for engaging the support member with at least one of the transversely positioned load bearing members, means for controlling the spacing between the transversely extending load bearing beam members, and dampers for absorbing mechanical vibrations. The means for controlling the spacing between the transversely disposed load bearing members maintains a substantially equal distance between the load bearing members in response to movement within the gap of the expansion joint caused by seismic events and vehicular loads. The dampers may be connected to the assembly for engaging the support members to the load bearing members and/or to the means for controlling the distance between the load bearing members.

The expansion joint system will now be described in greater detail with reference to the FIGURES. It should be noted that the expansion joint system is not intended to be limited to the illustrative embodiments shown in the FIGURES.

FIG. 1 shows the expansion joint system 10 disposed between two spaced apart concrete sections 12, 14. Expansion joint system 10 includes a plurality of vehicular load bearing members 16. The vehicular load bearing beam members 16 of the system 10 are positioned in the gap 18 between the spaced apart, adjacent roadway sections 12, 14. According to certain embodiments, the load bearing beam members 16 have a generally square or rectangular cross section. It should be noted, however, that the load bearing members 16 are not limited to beam members having approximately square or rectangular cross sections, but, rather, the load bearing beam members 16 may comprise any number of cross sectional configurations or shapes. The shape of the cross section of load bearing beams 16 is only limited in that the shape of the load bearing beams 16 must be capable of providing relatively smooth and unimpeded vehicular traffic across the top surfaces of the beams. Additionally, the top surfaces of the load bearing beams 16 may be contoured to facilitate the removal of debris and liquids, such as rainwater runoff.

The load bearing beam members 16 are positioned in a spaced-apart, side-by-side relationship and extend transversely in the expansion joint relative to the direction of vehicle travel. The top surfaces 20 of the load bearing beam members 16 are adapted to support vehicle tires as a vehicle passes over the expansion joint. Compressible seals 22 are typically placed and extend between the positioned vehicular load bearing beam members 16 adjacent the top surfaces 20 of the beam members 16 to fill the spaces between the beam members 16. Seals 24 can also be placed and extend in the space between edge plates 26, 28 of the expansion joint system 10 and end beam members 25, 27 that are located at opposite longitudinal sides of the expansion joint system 10. The seals 22, 24 should be flexible and compressible and, therefore, can stretch and contract in response to movement of the load bearing beams 16 within the expansion joint. The seals 22, 24 are preferably made from a durable and abrasion resistant elastomeric material. The seal members are not limited to any particular type of seal. Suitable sealing members that can be used include, but are not limited to, strip seals, glandular seals, and membrane seals. The system 10 may also include anchoring bolts 30, 32 to affix the expansion joint system to the underlying concrete substrate. Anchoring rods, studs, or similar anchoring devices may be used in place of bolts 30, 32.

Still referring to FIG. 1, according to one embodiment, the expansion joint system 10 includes at least one support bar member 34. If more than one support bar member 34 is utilized, then the plurality of support bar members 34 are positioned in a spaced-apart relationship and extend longitudinally within the expansion joint relative to the direction of the flow of vehicular traffic. That is, the support bars 34 extend substantially parallel relative to the direction of vehicle travel across the expansion joint 10. The support bars 34 provide support to the vehicle load bearing beams 16 as vehicular traffic passes over the expansion joint. The support bars 34 also accommodate transverse, longitudinal, and vertical movement of the expansion joint system 10 within the gap 18. The support member 34 may be an elongated bar-like member having a square cross section. It should be noted, however, that the support members 34 are not limited to those elongated bar members having square cross sections, but, rather, the support member may comprise an elongated bar member having a number of different cross sectional shapes such as, for example, round, oval, oblong and rectangular. The support bar 34 includes opposite ends 36, 38. Dampers 21 are attached between adjacent vehicle load bearing members 16 to absorb mechanical vibrations by means of damper attachment arms. Damper 29 is connected between support bar member 34 and the underlying concrete substrate 14 by means of damper attachment arms 29*a*, 29*b*.

Figure 2:
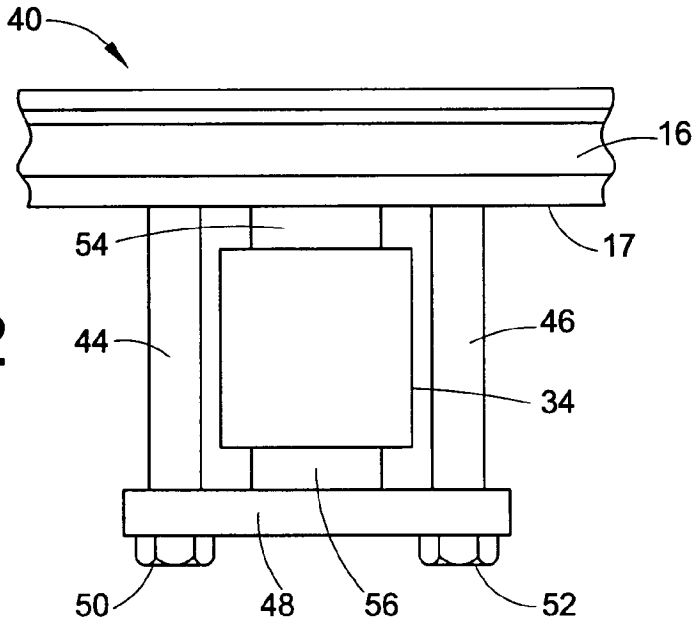
FIG. 2 is a side view of the means for engaging the support bar members to the load bearing beams.

Now referring to FIG. 2, an assembly 40 is provided for movably engaging the support members 34 with the load bearing beams 16 and to maintain the position of support bar members 34 relative to the bottom surfaces 17 of the load bearing beams members 16. The assembly 40 also permits longitudinal and limited vertical movement of the support bars 34 within the assembly 40. Assembly 40 is constructed to provide free sliding movement of the support bar members 34 within assembly 40. Any assembly that is capable of movably engaging the support members 34 with the load bearing beams 16 and is capable of maintaining the position of support bar members 34 relative to the bottom surfaces 17 of the load bearing beams members 16 may be used.

Still referring to FIG. 2, in one embodiment, the assembly 40 for engaging the support members 34 with the load bearing beams 16 includes a yoke assembly 40. The yoke assembly 40 retains the position of the support bars 34 relative to the bottom surfaces of the load bearing beams 16 of the expansion joint system 10. The yoke assembly 40 includes spaced-apart yoke side plates 44, 46 that are attached to and extend away from the bottom surfaces 17 of the vehicular load bearing beams 16. Horizontally disposed yoke plate 48 extends between yoke plates 44, 46. The yoke assembly 40 includes upper and lower dampers 54, 56 to absorb mechanical vibration energy from seismic cycling and vehicular impact from traffic moving across the expansion joint system 10. Spring-loaded dampers, liquid or air filled dampers, or viscoelastic dampers can be employed to accommodate the vibrational energy. Bolts means 50, 52 are used to fasten yoke plate 48 to the downward extending yoke plates 44, 46. The bolts 50, 52 are used to increase the compression applied to the dampers within the yoke assembly. Increasing the compression on the dampers within the yoke increases the compressive force that is applied to the support bar member 34, which thereby increases the friction at the interface of the dampers 54, 56 and the surfaces of the support bar members 34. The increase in friction against the support bar members 34 increases the ability of the dampers 54, 56 to absorb mechanical vibration energy and covert it to heat energy. It should be noted that the compression applied to the dampers 54, 56 should not be such as to prevent vertical and longitudinal movement of the support bar within the yoke assembly 40.

Figure 2A:
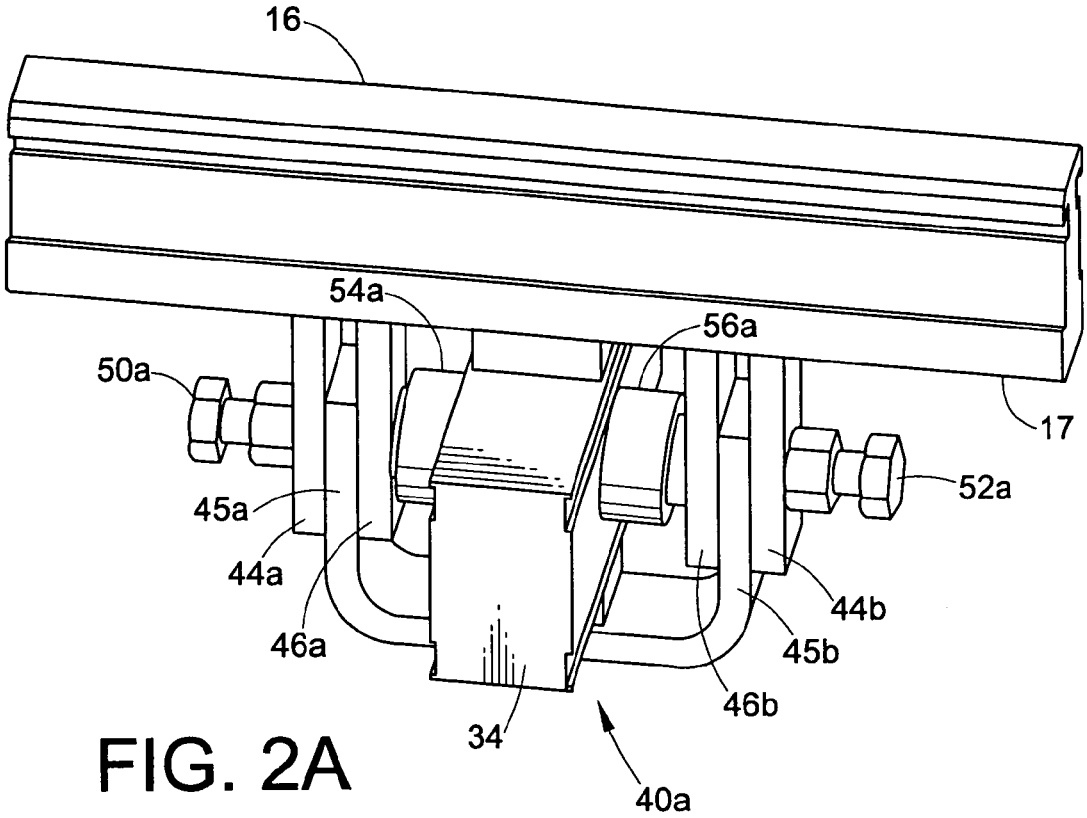
FIG. 2A is a side view of another embodiment of the means for engaging the support bar members to the load bearing beams.

Now referring to FIG. 2A, another embodiment of the yoke assembly 40*a* is shown with support member 34 passing therethrough. The yoke assembly 40*a* retains the position of the support bar 34 relative to the bottom surfaces 17 of the load bearing beams 16 of the expansion joint system 10. The yoke assembly 40*a* includes spaced-apart outside yoke side plates 44*a*, 44*b* that are attached to and extend away from the bottom surfaces 17 of the vehicular load bearing beams 16. The yoke assembly 40*a* also includes inner yoke side plates 46*a*, 46*b* that are spaced apart from outer yoke side plates 44*a*, 44*b*, respectively. The yoke assembly also includes U-shaped yoke plate including leg portions 45*a*, leg 45*b* and spanning portion. The yoke assembly 40*a* includes side dampers 54*a*, 56*a* to absorb mechanical vibration energy from seismic cycling and vehicular impact from traffic moving across the expansion joint system 10. Spring-loaded dampers, liquid or air filled dampers, or viscoelastic dampers can be employed. Bolts means 50*a*, 52*a* are used to fasten yoke plate leg portion 45*a* to downward extending yoke side plates 44*a*, 44*b*, 46*a*, 46*b*. The bolts 50*a*, 52*a* are used to increase the compression applied to the dampers 54*a*, 56*a* within the yoke assembly.

Figure 3:
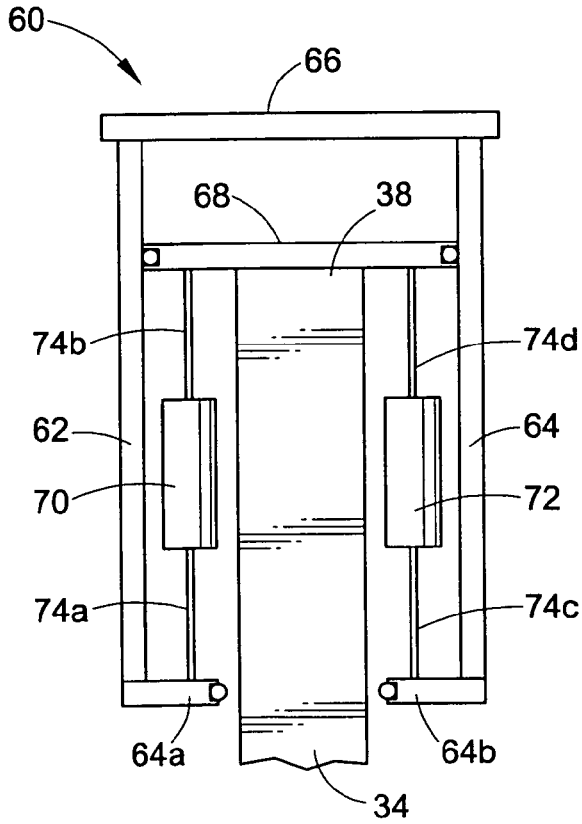
FIG. 3 is a top view of a receptacle for receiving an end of the support bar members.

Now referring to FIG. 3, according to a certain embodiment, each end 36, 38 of the support bars 34 may be received into a suitable receptacle 60 for accepting the ends of the support bars 34. The receptacles for accepting the support bars are disposed, or embedded in the "block-out" portions of respective adjacent roadway sections in the roadway construction. Provision is made for particular types of movement of the support bars 34 within the separate receptacle 60 for accepting the ends of the support members 34. In one embodiment, the receptacle 60 for accepting the ends of the support members comprises a box-like receptacle. It should be noted, however, that the receptacle for accepting the ends 36, 38 of the support bar members 34 may include any structure such as, for example, chambers, housings, containers, enclosures, channels, tracks, slots, grooves or passages, that includes a suitable cavity for accepting the end portions of the support bar members 34.

One end 36 of the support bar member 34 is adapted to be inserted into a receptacle for accepting that permits transverse and vertical movement, but substantially restricts longitudinal movement of the support member within the receptacle. The opposite end 38 of the support bar 34 is adapted to be inserted into a receptacle for accepting that permits longitudinal movement, but substantially restricts transverse and vertical movement of the support member 34 within the receptacle.

Still referring to FIG. 3, end 38 of support member 34 is inserted into receptacle 60, which permits longitudinal movement of the support bar member 34, but substantially prevents transverse movement. Receptacle 60 includes side plates 62, 64 and back plate 66. Top and bottom plates are not shown in FIG. 3. Dampers 70, 72 may be disposed on either side of support bar member 34, within receptacle 60. The dampers shown in FIG. 3 are the air-filled or liquid-filled type. Dampers 70, 72 are connected to anchor plate 68 and flanges 69*a*, 69*b* of receptacle 60 through damper connection arms 74*a*–74*d*. According to this embodiment, when the dampers receive mechanical vibration energy, caused by seismic events and vehicular loads, the dampers absorb the vibration, thereby providing resistance to joint expansion and contraction. In response to the applied of vibrational energy, the dampers work in the direction of the movement of the support bar members 34 so as not to counteract the functioning of the support bar 34 in response to the vibrations.

In another embodiment, the expansion joint system 10 may also include a mechanism for controlling the spacing between the transversely disposed load bearing beam members 16 in response to movement in the vicinity of the expansion joint. The mechanism for controlling the spacing between beam members typically maintains a substantially equal distance between the spaced-apart, traffic load bearing beams that are transversely positioned within the gap in an expansion joint, in response to movements caused by thermal or seismic cycling and vehicle deflections.

Figure 4:
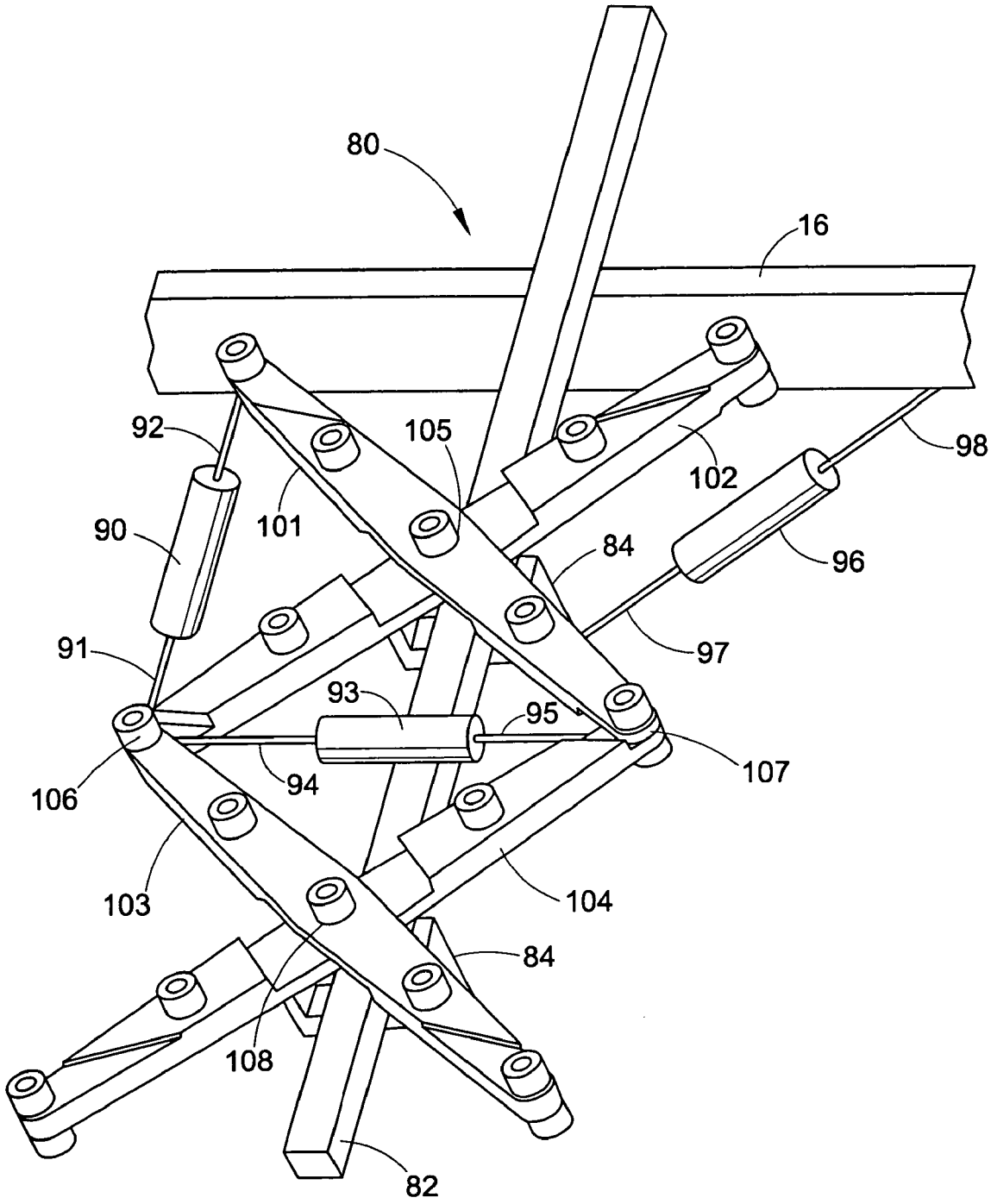
FIG. 4 is a top perspective view of the mechanism for controlling the spacing between the between the load bearing members.

FIG. 4 shows a perspective view of a suitable means 80 for controlling the spacing between the load bearing beams 16, which may be provided with damping means and incorporated into the expansion joint system 10. Generally, mechanism 80 provides for relative movement of the transversely disposed load bearing beam members 16 in the direction of vehicular traffic flow, that is, movement of the load bearing beams 16 in the longitudinal direction relative to one another. The mechanism 80 includes an expansion and contraction means 100, a stabilizing member 82, and an assembly 84 for engaging the expansion and contraction means 100 to the stabilizing member 82 and, optionally, to at least one load bearing member 16. In one embodiment, the mechanism 80 includes a stabilizing bar member 82, at least one yoke assembly 84, and an expansion and contraction means 100.

The stabilizing bar 82, in one embodiment, is a substantially elongated, square-shaped (in cross-section) bar member having opposite first and second ends. The stabilizing bar 82 is not limited to having an approximately square-shape section, but, rather, the stabilizing bar may have a number of cross sectional shapes. The elongated stabilizing bar 82 of the mechanism is movably engaged to the expansion and contraction means 100 by at least one yoke assembly 84. According to this construction, the stabilizing bar 82 member is not fixedly attached to either the yoke assembly 84 or to the expansion and contraction means 100 of the mechanism 80. The stabilizing bar 82 passes through the yoke assembly 84 and is slidingly engaged thereby. The yoke assembly 84 may comprise a number of yoke plates having recessed roller grooves on the inwardly facing surfaces. The recessed roller grooves are adapted to house roller means, which facilitate the sliding of the stabilizing bar 82. In operation, the stabilizing bar 82 can move within the yoke assembly 84 in the space defined between the rollers The use of at least one yoke assembly 84 maintains the position of the stabilizing bar during movement within the gap in the expansion joint. During movement in the gap in the expansion joint, the stabilizing bar 82 can move vertically against side rollers in a rolling fashion. During movement in the gap in the expansion joint, the stabilizing bar 82 can also slide longitudinally against upper and lower rollers. The use of vertical side rollers and upper and lower rollers permits the yoke assembly to be attached to one of the vehicular load bearing beams, while maintaining controlled movement of the stabilizing bar 82 without having to fixedly attached the stabilizing bar 82 to the load bearing members 16 or to the yoke assembly 84.

While the yoke assembly 84 has been described with respect to one embodiment, it should be noted that the yoke assembly 84 can comprise other configurations that are capable of engaging the elongated stabilizing bar 82. Another non-limiting configuration of the yoke assembly 84 includes, for example, a saddle-like assembly that can engage the stabilizing bar.

Figure 5:
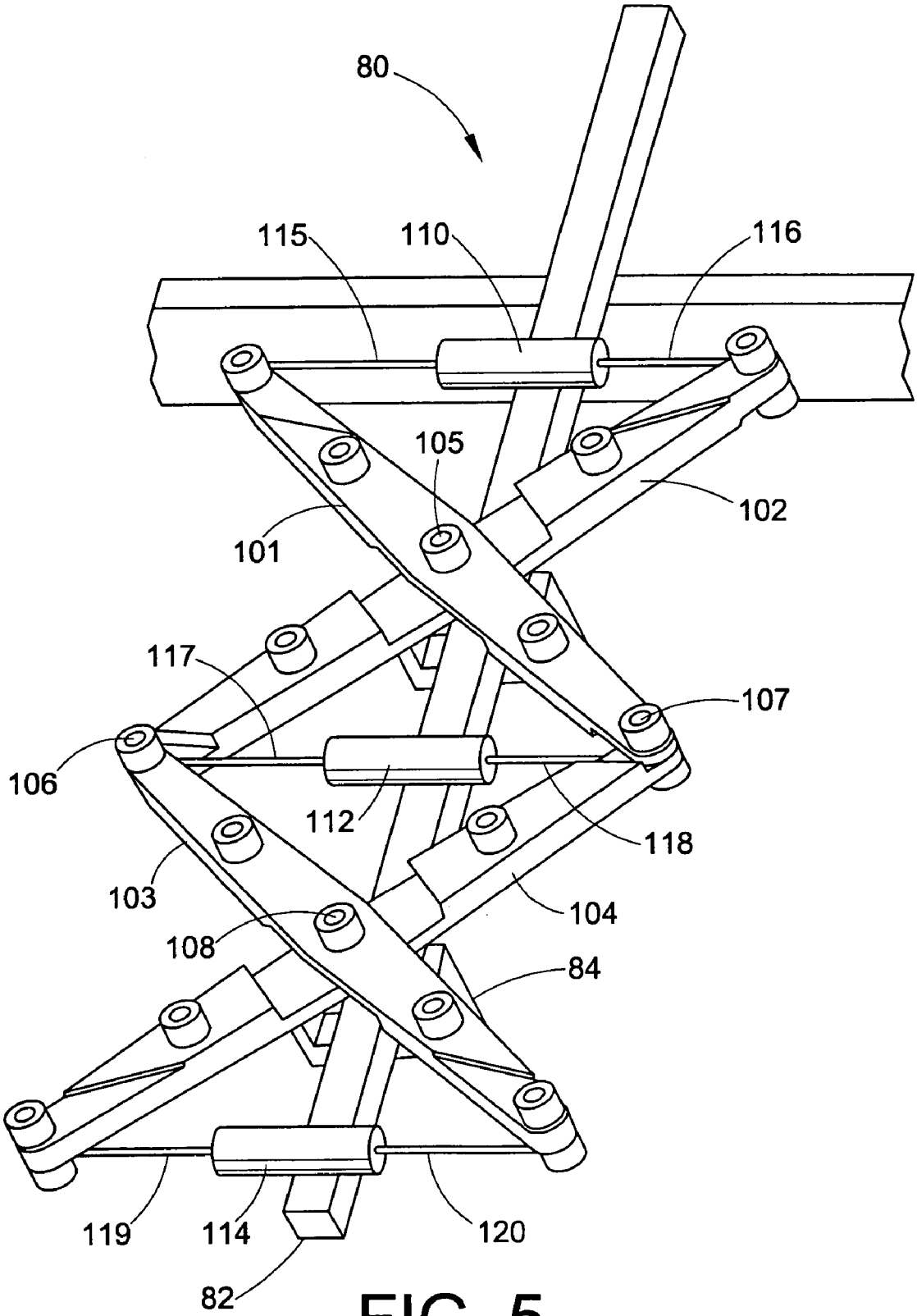
FIG. 5 is a bottom plan view of the expansion and contraction means incorporating dampers for use in one embodiment of the expansion joint system.

According to one embodiment, the expansion and contraction means 100 is an expandable and contractable accordion-type mechanism. FIGS. 4 and 5 show expansion and contraction means 100 that includes a plurality of arms 101–104 that are pivotably attached to one another at pivot points 105–108 to allow free expansion and contraction of the mechanism 100 in a longitudinal direction relative to the flow of vehicular traffic across the expansion joint. It should be noted that the expansion and contraction means 100 can include fewer or more arms, depending on the desired application. Furthermore, the mechanism 80 may comprise only the expansion and contraction means 100, and can be provided without the stabilizing bar 82 or yoke assembly 84. At least one pivot point of the expansion and contraction means can be mechanically attached to one of the load bearing beams by bolting or pinning. As shown in FIG. 4, damper 90 is connected to arms 101, 102 via damper attachment arms 91, 92. Damper 93 is connected at pivot point 106 of arms 102, 103 via damper attachment arm 94 and to pivot point 107 of arms 101, 104 via damper attachment arm 95. Damper 96 is connected between arm 102 via damper attachment arm 97 and to load bearing member 16 via damper attachment arm 98. As shown in FIG. 5, the expansion and contraction means 100 may include dampers 110, 112, 114 that are connected thereto. Dampers 110, 112, 114 are connected to the arms 101–104 of means 100 through damper connection arms 115–120.

If the distance within the expansion joint increases, in response to seismic activity or vehicular load, the arms of the expansion and contraction means pivot toward the midline of the expansion and contraction means, thereby expanding the length of the expansion and contraction means in a longitudinal direction across the gap in the expansion joint. Conversely, if the distance within the expansion joint decreases, in response to seismic activity or vehicular loads, then the arms of the expansion and contraction means pivot in a direction away from the midline of the expansion and contraction means, thereby contracting the expansion and contraction means in a longitudinal direction across the gap in the expansion joint. As the expansion and contraction occurs within the expansion joint, the dampers 110, 112, 114 resist the longitudinal expansion and contraction of the expansion and contraction means.

Dampers may also be incorporated into expansion joints known in the industry as "swivel joints." According to one embodiment, dampers may be integrated into a swivel joint of the kind disclosed in U.S. Pat. No. 4,674,912, the disclosure of which is hereby incorporated by reference.

Figure 6:
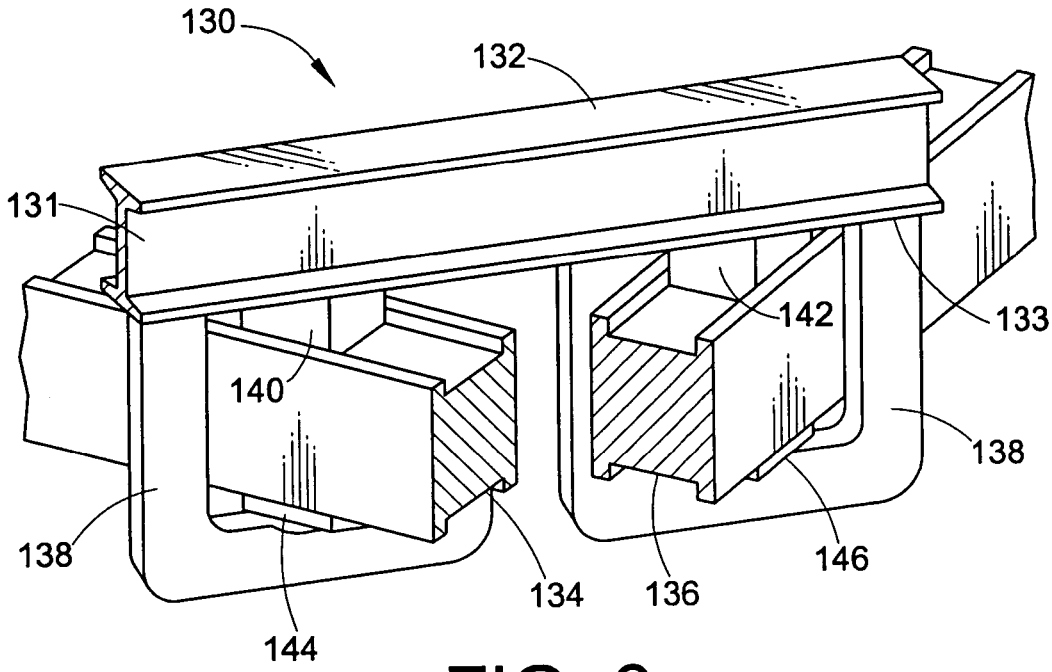
FIG. 6 is a perspective view of a swivel joint expansion system with damping means incorporated therein.
Figure 6A:
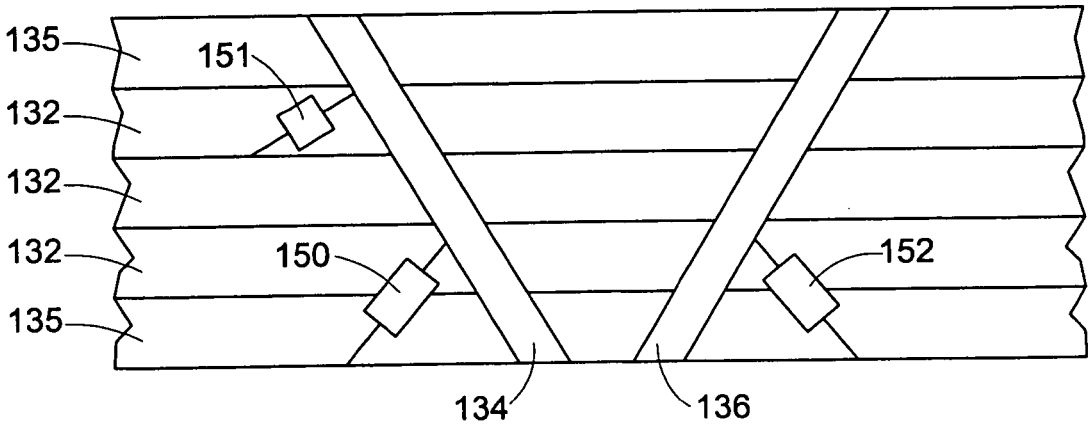
FIG. 6A is a schematic representation of a bottom view of a swivel joint expansion system expansion joint system.

According to FIG. 6, the swivel-type expansion joint system 130 includes at least one transversely extending load bearing member 131 having top 132 and bottom 133 surfaces. In the embodiment shown, elongated support members 134, 136 are positioned below the transversely extending load bearing member 131. The support members 134, 136 are swivelingly and slidingly supported at its two ends on different sides of the expansion joint so as to extend across the gap at an angle relative to the load bearing beams 131. Means 138 are provided for swivelingly and slidingly supporting and engaging the support members 134, 136 to the transversely extending load bearing members 131. Damping means 140, 142, 144, 146 are engaged with the upper and lower surfaces of support member 134, 136. FIG. 6A shows dampers positioned between support members 134, 136 and load bearing members 132. Again, the dampers do not create enough friction to hinder the movement of the support bar member 134, 136 within the U-shaped support structures 138. Referring to FIG. 6A, damper 150 is connected between support member 134 and load bearing edge member 135. Damper 151 is connected between support bar member 134 to load bearing beam member 132. Damper 152 is connected between support bar member 136 and load bearing edge member 135.

Thus, it is demonstrated that dampers may be connected (i) between the vehicular traffic load bearing members, (ii) between the load bearing members and the means for engaging the support bar members to the load bearing members, (iii) between the load bearing members and the elongated support bar members, (iv) between the load bearing members and the expansion and contraction means, (v) between the support bar members and the means for engaging the support elongated members to the load bearing members, (vi) between the elongated support bar members and the means for engaging the elongated support bar members to the load bearing members, (vii) between the elongated support bar members and at least one (a) the first receptacle for accepting the elongated support bar members or (b) the second receptacle for accepting the elongated support bar member, and (viii) between the elongated support bar members and at least one (a) said first receptacle for accepting the elongated support bar members and/or (b) the second receptacle for accepting the elongated support bar members.

Dampers can be incorporated in an expansion joint systems at multiple locations, and can be engaged or otherwise connected to a variety of expansion joint components, in order to absorb and dissipate mechanical energy applied to the expansion joint system.

Damping means can be incorporated in a wide variety of expansion joint systems, including, but not limited to, modular expansion joint systems, hybrid modular expansion joint systems, swivel expansion joint systems, plate expansion joint systems and finger expansion joint systems.

The expansion joint system is used in the gap between spaced apart, adjacent concrete roadway sections, such as highways and bridges. To install the expansion joint system, concrete is typically poured into the "block-out" portions of adjacent roadway sections. The gap is provided between first and second roadway sections to accommodate expansion and contraction due to thermal fluctuations and seismic cycling. The expansion joint system can be affixed within the block-out portions between two roadway sections by disposing the system into the gap between the roadway sections and pouring concrete into the block-out portions or by mechanically affixing the expansion joint system in the gap to underlying structural support. Mechanical attachment may be accomplished, for example, by bolting or welding the expansion joint system to the underlying structural support.

The expansion joint system including damping means has a capacity for a high level of vibration energy absorbability and dissipation that can accommodate expansion and contraction within an expansion joint that occurs in response to seismic events and vehicular traffic. The expansion joint system also provides the gap with a watertight seal to prevent the ingress of runoff water.

While the expansion joint system has been described above in connection with the preferred embodiments, as shown in the various figures, it is to be understood that other similar embodiments may be used or modifications and additions may be made to the described embodiments for performing the same function without deviating therefrom. Further, all embodiments disclosed are not necessarily in the alternative, as the various embodiments may be combined to provide the desired characteristics. Variations can be made by one having ordinary skill in the art without departing from the spirit and scope of the invention.

We claim:

1. An expansion joint system for a roadway construction wherein a gap is defined between adjacent first and second roadway sections, said expansion joint system extending across said gap to permit vehicular traffic, said expansion joint system comprising:

transversely extending load bearing members having top and bottom surfaces, wherein said top surface is adapted to support vehicular traffic;

elongated support members having opposite ends extending longitudinally across said expansion joint from said first roadway section to said second roadway section, wherein said elongated support members are positioned below said transversely extending load bearing members;

means for movably engaging said elongated support members with at least one of said transversely extending load bearing members; and dampers positioned between at least one of said transversely extending load bearing members and said means for engaging said elongated support members with at least one of said transversely extending load bearing members.

2. The expansion joint system of claim 1, further comprising dampers connected between two adjacent transversely extending load bearing members.

3. The expansion joint system of claim 2, wherein said dampers are connected to said bottom surfaces of said transversely extending load bearing members and to said means for engaging said elongated support members with said transversely extending load bearing members.

4. The expansion joint system of claim 3, wherein said means for engaging said elongated support members with at least one of said transversely extending load bearing members comprises a yoke assembly and wherein said dampers are connected to said bottom surfaces of said transversely extending load bearing members and to said yoke assembly.

5. The expansion joint system of claim 2, comprising at least one first receptacle for accepting an end of said at least one longitudinally extending elongated support member, wherein said first receptacle for accepting substantially restricts transverse movement within said at least one first receptacle for accepting, but permits longitudinal and vertical movement within said first receptacle for accepting; and at least one second receptacle for accepting an end of said at least one longitudinally extending elongated support member, wherein said second receptacle for accepting substantially restricts longitudinal movement within said second receptacle for accepting, but permits transverse and vertical movement within said second receptacle for accepting, wherein said at least one elongated support member has one end located within said first receptacle for accepting and the opposite end located in said second receptacle for accepting.

6. The expansion joint of claim 5, wherein dampers are connected between said elongated support members and at least one of (i) said first receptacle for accepting and (ii) said second receptacle for accepting.

7. The expansion joint system of claim 1, comprising at least one expansion and contraction means for controlling the spacing between said transversely extending load bearing members comprising pivotably attached arms that are movably engaged with said load bearing members.

8. The expansion joint system of claim 7, wherein dampers are connected between said expansion and contraction means and at least one of said transversely extending vehicle load bearing members.

9. The expansion joint system of claim 1, further comprising flexible seals extending between at least one of (i) said load bearing members and (ii) said load bearing members and edge sections of said first and said second roadway sections.

10. The expansion joint system of claim 1, wherein said dampers are selected from the group consisting of spring-loaded dampers, liquid-filled dampers, air-filled dampers, friction dampers, or viscoelastic material dampers.

11. The expansion joint system of claim 1, wherein said at least one support member swivelingly and slidingly supported at its two ends on different longitudinal sides of the expansion joint system so as to extend across the gap at an angle.

12. An expansion joint system for a roadway construction wherein a gap is defined between adjacent first and second roadway sections, said expansion joint system extending across said gap to permit vehicular traffic, said expansion joint system comprising:

transversely extending load bearing members having top and bottom surfaces, wherein said top surface is adapted to support vehicular traffic;

elongated support members having opposite ends extending longitudinally across said expansion joint from said first roadway section to said second roadway section, wherein said elongated support members are positioned below said transversely extending load bearing members;

at least one first receptacle for accepting an end of one longitudinally extending elongated support member, wherein said first receptacle for accepting substantially restricts transverse movement within said one first receptacle for accepting, but permits longitudinal and vertical movement within said first receptacle for accepting;

at least one second receptacle for accepting an end of one longitudinally extending elongated support member, wherein said second receptacle for accepting substantially restricts longitudinal movement within said second receptacle for accepting, but permits transverse and vertical movement within said second receptacle for accepting, wherein said one elongated support member has one end located within said first receptacle for accepting and the opposite end located in said second receptacle for accepting;

means for movably engaging said elongated support members with at least one of said transversely extending load bearing members; and dampers connected between said ends of said elongated support members and at least one of (i) said first receptacle for accepting said elongated support members and (ii) said second receptacle for accepting said elongated support members.

13. The expansion joint system of claim 12, further comprising dampers connected between two adjacent transversely extending load bearing members.

14. The expansion joint system of claim 12, wherein said dampers are connected to and positioned within at least one of (i) said first receptacle for accepting said elongated support members and (ii) said second receptacle for accepting said elongated support members by means of longitudinally extending damper attachment arms.

15. The expansion joint of claim 12, wherein dampers are connected between elongated said support members and at least one of (i) said first receptacle for accepting and (ii) said second receptacle for accepting.

16. The expansion joint system of claim 12, wherein means for engaging said elongated support members with at least one of said transversely extending load bearing members comprises a yoke assembly and wherein said dampers are connected to at least one of (i) said bottom surfaces of said transversely extending load bearing members and (ii) said means for engaging said elongated support members with at least one of said transversely extending load bearing members.

17. The expansion joint system of claim 12, comprising at least one expansion and contraction means for controlling the spacing between said load bearing members comprising pivotably attached arms that are movably engaged with said load bearing members.

18. The expansion joint system of claim 17, comprising dampers connected between at least two pivotably attached arms of said expansion and contraction means.

19. The expansion joint system of claim 18, comprising dampers connected between at least one pivotably attached arms of said expansion and contraction means and at least one transversely extending load bearing member.

20. The expansion joint system of claim 12, comprising seals extending between at least one of (i) said transversely extending load bearing members and (ii) said transversely extending load bearing members and edge sections of said first and said second roadway sections.

21. The expansion joint system of claim 12 wherein said dampers are selected from the group consisting of spring-loaded dampers, liquid-filled dampers, air-filled dampers, friction dampers, or viscoelastic material dampers.

22. The expansion joint system of claim 12, wherein said at least one support member swivelingly and slidingly supported at its two ends on different longitudinal sides of the expansion joint system so as to extend across the gap at an angle.

23. An expansion joint system for a roadway construction wherein a gap is defined between adjacent first and second roadway sections, said expansion joint system extending across said gap to permit vehicular traffic, said expansion joint system comprising:

transversely extending load bearing members having top and bottom surfaces, wherein said top surface is adapted to support vehicular traffic;

elongated support members having opposite ends extending longitudinally across said expansion joint from said first roadway section to said second roadway section, wherein said elongated support members are positioned below said transversely extending load bearing members;

means for movably engaging said elongated support members to at least one of said transversely extending load bearing member;

at least one expansion and contraction means for controlling the spacing between said load bearing members comprising pivotably attached arms that are movably engaged with said load bearing members; and dampers connected to said pivotably attached arms of said expansion and contraction means.

24. The expansion joint system of claim 23, further comprising dampers connected between two adjacent transversely extending load bearing members.

25. The expansion joint system of claim 23, comprising at least one first receptacle for accepting an end of said longitudinally extending elongated support members, wherein said first receptacle for accepting substantially restricts transverse movement within said at least one first receptacle for accepting, but permits longitudinal movement within said first receptacle for accepting; and at least one second receptacle for accepting an end of said longitudinally extending elongated support members, wherein said second receptacle for accepting substantially restricts longitudinal movement within said second receptacle for accepting, but permits transverse and vertical movement within said second receptacle for accepting, wherein said at least one elongated support member has one end located within said first receptacle for accepting and the opposite end located in said second receptacle for accepting.

26. The expansion joint system of claim 25, comprising dampers connected to and positioned within at least one of (i) said first receptacle for accepting said elongated support members and (ii) said second receptacle for accepting said support members.

27. The expansion joint system of claim 26, wherein said dampers are connected to and positioned within at least one of (i) said first receptacle for accepting said elongated support members and (ii) said second receptacle for accepting said elongated support members by means of longitudinally extending damper attachment arms.

28. The expansion joint system of claim 26, wherein said dampers are connected between said elongated support members and at least one of (i) said first receptacle for accepting and (ii) said second receptacle for accepting.

29. The expansion joint system of claim 25, comprising dampers connected to at least one of (i) said transversely extending load bearing members and (ii) said means for engaging said elongated support members to said transversely extending load bearing members.

30. The expansion joint system of claim 29, wherein said means for engaging said elongated support members with at least one of said transversely extending load bearing members comprises a yoke assembly and wherein said dampers are connected to at least one of (i) the bottom surfaces of said transversely extending load bearing members and (ii) said means for engaging said elongated support members with at least one of said transversely extending load bearing members.

31. The expansion joint system of claim 25, comprising seals extending between at least one of (i) said load bearing members and (ii) said load bearing members and edge sections of said first and said second roadway sections.

32. The expansion joint system of claim 25, wherein said dampers are selected from the group consisting of spring-loaded dampers, liquid-filled dampers, air-filled dampers, friction dampers, and viscoelastic material dampers.

33. The expansion joint system of claim 25, wherein said at least one support member swivelingly and slidingly supported at its two ends on different longitudinal sides of the expansion joint system so as to extend across the gap at an angle.

34. An expansion joint system for a roadway construction wherein a gap is defined between adjacent first and second roadway sections, said expansion joint system extending across said gap to permit vehicular traffic, said expansion joint system comprising:

transversely extending load bearing members having top and bottom surfaces, wherein said top surface is adapted to support vehicular traffic;

elongated support members having opposite ends extending longitudinally across said expansion joint from said first roadway section to said second roadway section, wherein said elongated support members are positioned below said transversely extending load bearing member;

means for movably engaging said elongated support members with at least one of said transversely extending load bearing members; and dampers connected between at least two components selected from the group consisting of (a) said transversely extending load bearing members, (b) said elongated support members, and (c) said means for movably engaging said elongated support members with at least one of said transversely extending load bearing members.

35. The expansion joint system of claim 34, further comprising at least one first receptacle for accepting an end of said longitudinally extending elongated support members, wherein said first receptacle for accepting substantially restricts transverse movement within said at least one first receptacle for accepting, but permits longitudinal movement within said first receptacle for accepting; and at least one second receptacle for accepting an end of said longitudinally extending elongated support members, wherein said second receptacle for accepting substantially restricts longitudinal movement within said second receptacle for accepting, but permits transverse and vertical movement within said second receptacle for accepting, wherein said elongated support member has one end located within said first receptacle for accepting and the opposite end located in said second receptacle for accepting.

* * * * *